United States Patent [19]

Brock et al.

[11] 4,326,563

[45] Apr. 27, 1982

[54] CONTROL FOR A DOBBY MECHANISM

[75] Inventors: Josef Brock, Viersen; Paul Surkamp, Krefeld, both of Fed. Rep. of Germany

[73] Assignee: Maschinenfabrik Carl Zangs Aktiengesellschaft, Krefeld, Fed. Rep. of Germany

[21] Appl. No.: 77,866

[22] Filed: Sep. 21, 1979

[30] Foreign Application Priority Data

Sep. 22, 1978 [DE] Fed. Rep. of Germany ..... 2841281

[51] Int. Cl.[3] ..... D03C 1/12

[52] U.S. Cl. ..... 139/76

[58] Field of Search ..... 139/66 R, 67, 68, 69, 139/70, 71, 72, 73, 74

[56] References Cited

U.S. PATENT DOCUMENTS 3,730,232 5/1973 Kleiner ..... 139/66 R 3,804,128 4/1974 Amigues ..... 139/66 R

FOREIGN PATENT DOCUMENTS 320577 1/1972 U.S.S.R. ..... 139/66 R

*Primary Examiner*—Henry Jaudon

*Attorney, Agent, or Firm*—Martin A. Farber

[57] ABSTRACT

A control for a wedge coupling in a dobby mechanism with a reduction gear or step-down gearing between a drive shaft and an eccentric device for the dobby movement, a coupling place, and a switching member (which member is controlled according to a pattern or design) for the movement of the wedge, the switching member being under spring tension. Two control levers for the upper and lower shed movement are provided, which control levers are under spring tension and which engage or act on the switching member and are controlled by a known needle mechanism, one of the control levers additionally cooperating with a control axle, which axle is synchronously moveable with the shaft machine. A pulse element is synchronously controlled by the eccentric device (connecting rod), by which pulse element the control end of the not to be moved control lever is blocked in its starting position.

10 Claims, 11 Drawing Figures

CONTROL FOR A DOBBY MECHANISM

Figure 1:
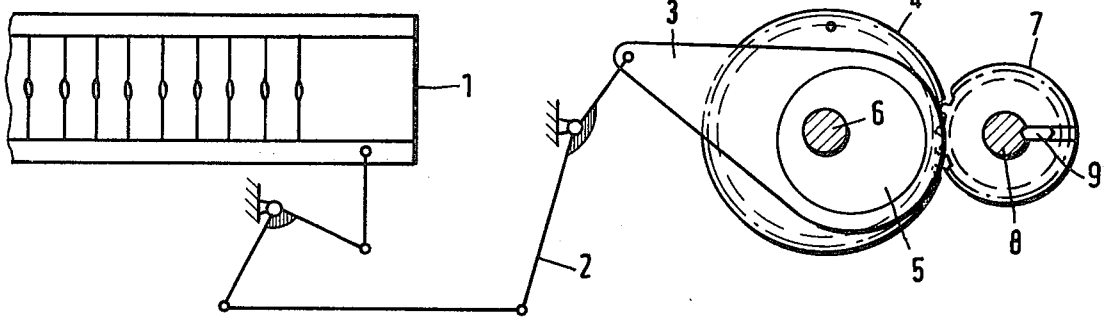

The invention relates to a control for a wedge coupling in a dobby mechanism with a reduction gear or step-down gearing between a drive shaft and an eccentric device for the shaft movement, a coupling place, and a switching member (which member is controlled according to a pattern or design) for the movement of the wedge, the switching member being under spring tension.

A dobby mechanism with a step-down or reduction gear between a drive shaft and an eccentric device for the shaft movement, as well as with a wedge coupling is known from the German Pat. No. 957 648. With this known dobby mechanism, the switching member for the movement of the wedge is controlled with stroke bodies of a stroke body card. This known control or control mechanism is not in a position to keep up with the speeds of modern weaving or textile machines.

Furthermore from the German Pat. No. 1 535 207 a lifter or notched bar control for a dobby mechanism is known, whose notched bars or lifters are controlled by means of lifter carriers, the carriers being suspended from control levers, whereby respectively, each two pressing needles are connected via a balance lever with a control lever. With such a type of notched bar control it is indeed possible to achieve higher speeds, because with the notched bar exchange or replacement, one of the pressing needles goes into the operative position and the other pressing needle remains in its rest position, so that the control lever and therewith also the notched bar carrier and the notched bar which is suspended from the latter do not have to execute two consecutive movements, but stay at rest because the opposite movements of the two pressing needles mutually cancel each other out.

The invention has the task to create a control for the wedge coupling of a dobby mechanism of the type described in the beginning which permits a considerable increase of the numbers of rounds or picks.

This task is solved by the present invention by means of a control with two control levers for the upper and lower shed movement, which control levers are under spring tension and which engage or act on the switching member and are controlled by a known needle mechanism, of which the one control lever additionally cooperates with a control axle, which axle is synchronously moveable with the dobby mechanism and by a pulse element, which pulse element is synchronously controlled by the eccentric device, with which pulse element the control end of the not to be moved control lever is blocked in its starting position.

With a practical embodiment the known balance lever can be arranged between the needle mechanism and the control levers, the balance lever cooperating with the two pressure needles.

Furthermore it has proven advantageous to arrange that one of the two control levers which cooperates with the control axle with an oblong hole on the control axle, whereby the length ratios between the pivot axle of the balance lever, the control axle and a pin on the switching member are dimensioned such that with a stroke of the pivot axle of the balance lever and of the control axle, no coupling pulse occurs at the pin of the switching member.

A control formed according to the invention not only has the advantage that it permits considerably higher speeds than the known control with a stroke body card, but at the same time it makes it possible to utilize the advantage of the known balance lever construction for the control of a rotation shaft machine.

Figure 2:
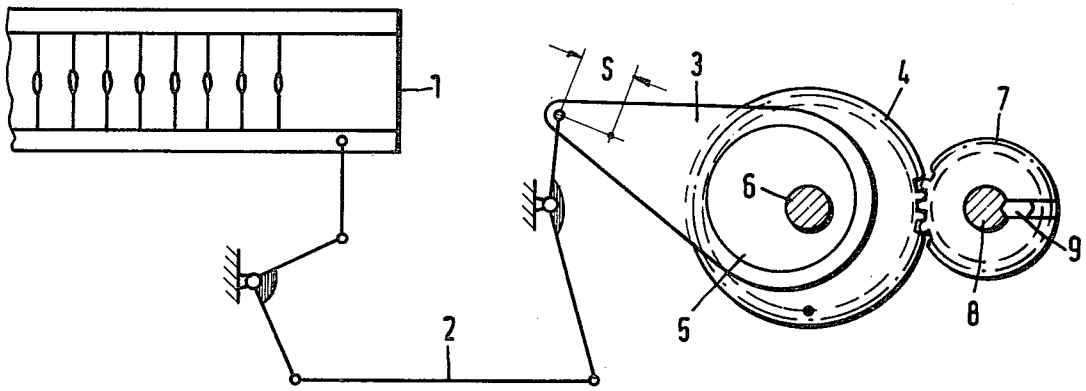
Figure 4:
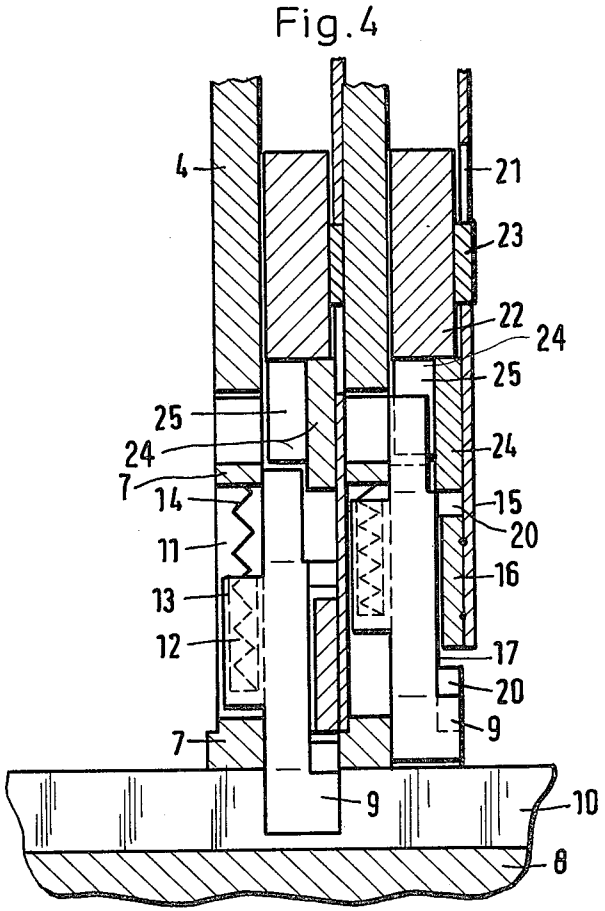
Figure 3:
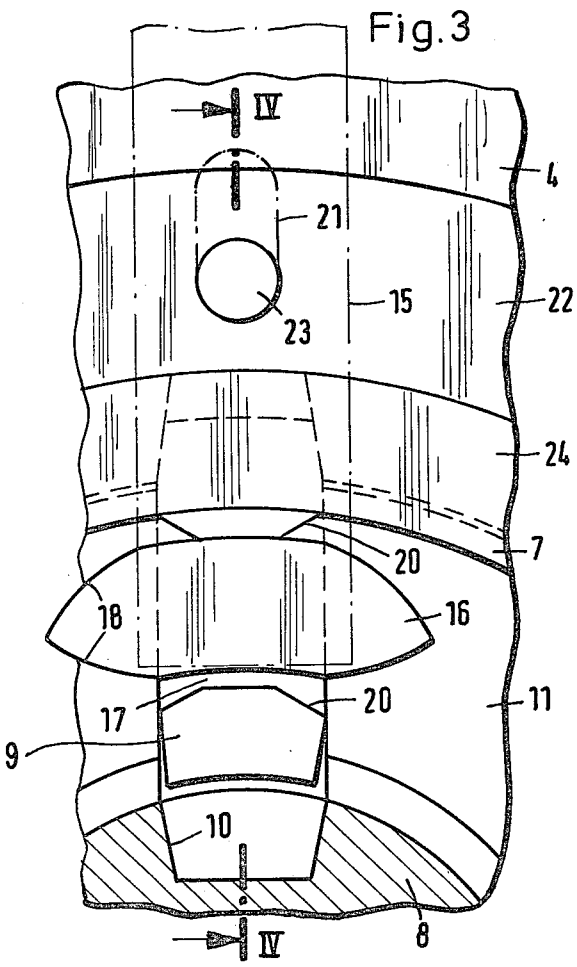
Figure 5:
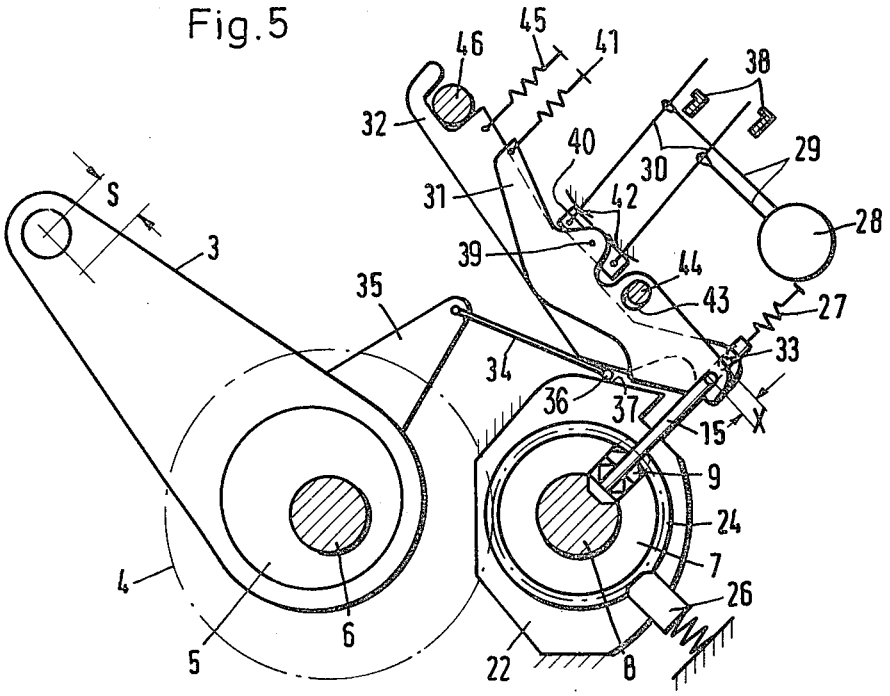
Figure 5A:
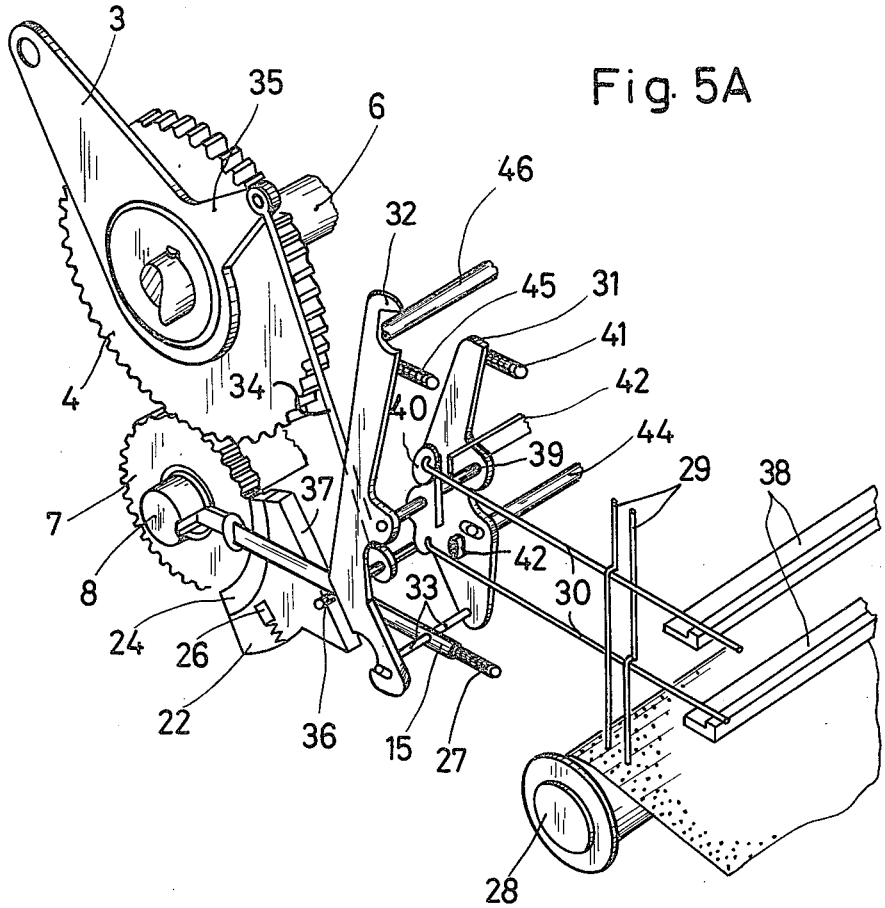
Figure 9:
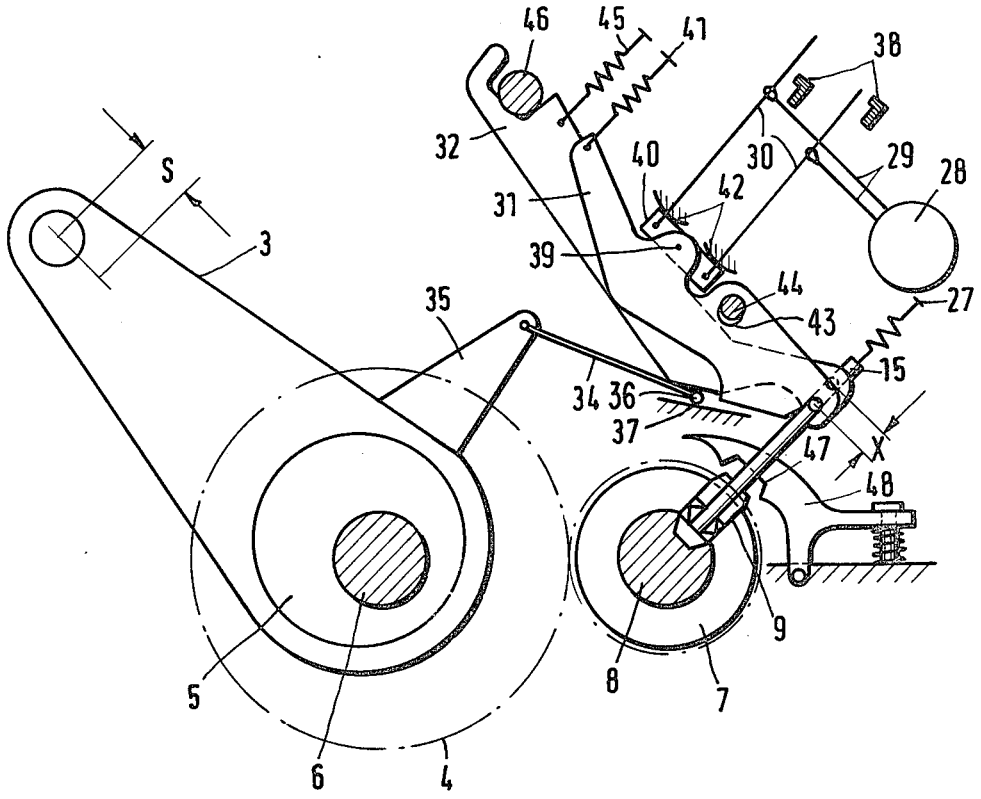
Figure 10:
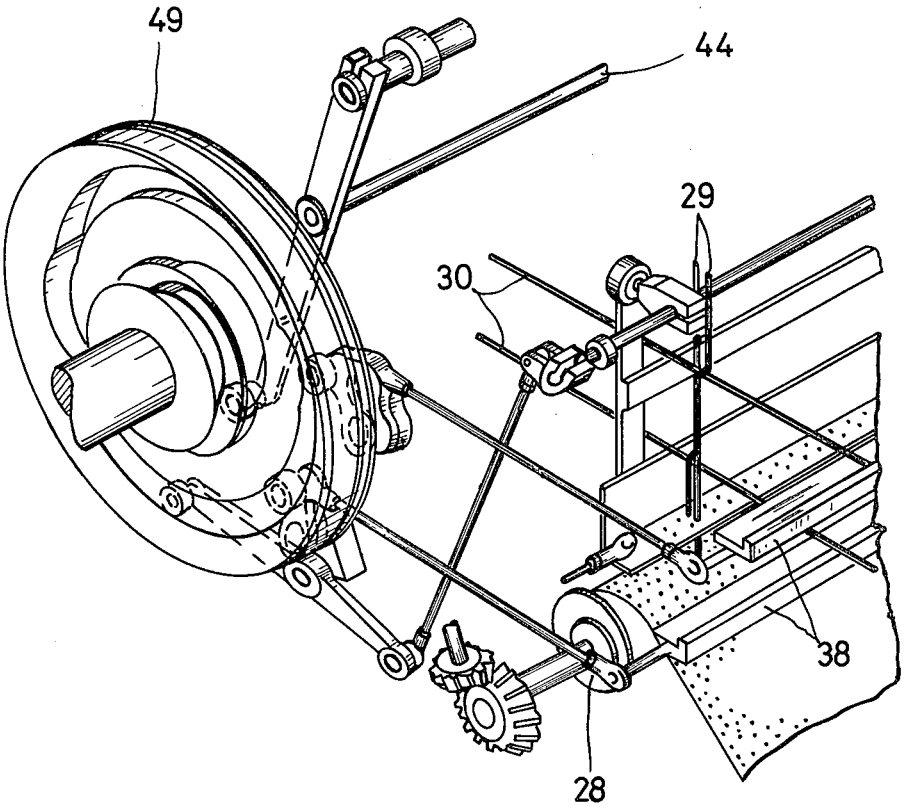

Further details, characteristics and advantages of a control according to the invention of a dobby mechanism will be seen in the herebelow description of the accompanying drawings, in which a preferred embodiment is shown in plan views and sections. In the drawings are shown:

FIG. 1 a schematic illustration of a dobby in the bottom shed position and of its drive;

FIG. 2 a schematic illustration of a dobby in the upper shed position and of its drive;

FIG. 3 a side view of a wedge coupling;

FIG. 4 the same wedge coupling sectioned along the line IV—IV in FIG. 3, and specifically with one wedge in the coupled condition and another wedge in the uncoupled condition;

FIGS. 5–8 schematic illustrations of the eccentric device with drive and control in four different coupling-, and respectively, control- positions;

FIG. 5A is a perspective schematic illustration of the control device according to FIG. 5;

FIG. 9 a schematic illustration of another embodiment example with pawl latch or catch for the wedge in the uncoupled position of the latter;

FIG. 10 is a perspective view of a drive device for the pressing rails of the needle mechanism and the movable control axle.

A dobby 1 is connected with a connecting rod 3 via a transmission or gearing 2, which gearing 2 is mounted on an eccentric disc 5, the disc 5 being secured to a toothed wheel or gear 4. The gear 4 and the eccentric disc 5 are secured on an axle 6.

An additional toothed wheel or gear 7 meshes with the gear 4, the gear 7 being mounted on a drive shaft 8. The diametical pitches of the gears 4 and 7 have a relationship of 2:1 so that one half a rotation of the gear 4 corresponds to a complete rotation of the gear 7. Through a complete rotation of the gear 7 the connecting rod 3 is moved from its bottom shed position shown in FIG. 1 by the path s into the upper shed position shown in FIG. 2, or respectively, is moved from the upper shed position again into the bottom shed position.

The gear 7 and the drive shaft 8 can be coupled with each other by means of a wedge 9. For this purpose the drive shaft 8 has a groove or keyway 10 that extends in the axial direction, whereas the gear 7 has a recess 11 extending in a radial direction, the wedge 9 with a shoulder 12 engaging in the recess 11. The shoulder 12 is provided with a blind hole 13 into which blind hole 13 a spring 14 is inserted, the spring being supported at its upper end in a portion of the gear 7. During a rotation the spring 14 holds the wedge 9 secure in its position of being coupled into the drive shaft 8.

The movement of the wedge 9 takes place by means of a switching rod 15 which at the end has a coupling member 16, which coupling engages in a groove or slot 17 of the wedge 9. The ends of the coupling member 16 are provided with cams 18, whereas the entrances and outlets of the slot 17 of the wedge 9 have inclined surfaces 20. The switching rod 15 is guided with the longitudinal hole 21 on a peg 23, the peg 23 being secured to a stationary guide ring 22.

A ring 24 is mounted in the guide ring 22, the ring 24 having a slot 25 in the coupling range for the wedge 9, the slot extending in the radial direction. In the uncoupled condition the wedge engages with its outer-lying end in the slot 25. The ring 24 overlaps the wedge 9 even still in the coupled condition, so that the latter during its rotation is secured against or prevented from displacements in the axial direction.

At the outer periphery of the ring 24 a detent is provided, which detent comprises a spring-biased, radially moveable stop or blocking wedge 26, so that in case of a faulty connection or control when the wedge 9 projects partially into the groove 10 of the drive shaft and partially also still into the slot 25 of the ring 24, the ring 24 can rotate therealong.

The control of the switching rod 15, which rod 15 is pulled by a tension spring 27 into its starting position, occurs according to a pattern or design by a card cylinder 28 by means of sensing needles 29, pressing needles 30 and two control levers 31, 32, the latter engaging or acting upon pin 33, which pin is connected with the switching rod 15. No hole in the card—not shown in the drawing—, which card is moved by the card cylinder 28 and scanned by the scanning needles 29 signifies that the coordinated dobby 1 is intended to be moved from the upper shed to the bottom shed or to remain in the bottom shed, whereas a hole in the card signifies that the associated shaft 1 is intended to be moved from the bottom shed to the upper shed or to remain in the upper shed.

The control levers 31, 32 receive from a pulse link or member 34 the information as to whether a dobby 1 is situated in the upper shed or in the bottom shed, the pulse member 34 being moved synchronously with the eccentric device. The pulse member 34 is articulated on a lever 35 (the lever 35 being connected with the connecting rod 3) and with a cylinder or roller 36 slides along on a cam 37, which cam is arranged on the stationary guide ring 22. The two control levers 31 and 32 can be blocked in their starting position by the roller 36 of the pulse member 34.

The function of the control for the coupling and uncoupling of the wedge 9 is very simple: In the drawing in FIG. 5 the associated or coordinated dobby 1 is in the upper shed. The two scanning needles have found no hole in the card and therewith supply the information that the dobby 1 should be moved into the bottom shed. The pressing needles 30 are not pressed or driven out by their sliding rails or pressure guides 38, so that a balance lever 40, which with a pivot axle 39 is mounted on the control lever 31, is drawn by a tension spring 41 toward the balance lever's limit stop or abutment 42. Since however the control lever 31 with a slotted hole 43 is arranged on a control axle 44 (the control axle being moveable synchronously with the shaft machine), the control lever is swung around its pivot axle 39 so that on the pin 33 of the switching rod 15 a coupling path x is produced and the wedge 9 is connected. The drive shaft 8 takes the connected wedge 9 along therewith and, by means of the step-down gearing, the latter comprising toothed gears 4 and 7, moves the eccentric disc 5 by 180°, so that the associated dobby 1 is moved from the upper shed to the bottom shed.

Figure 6:
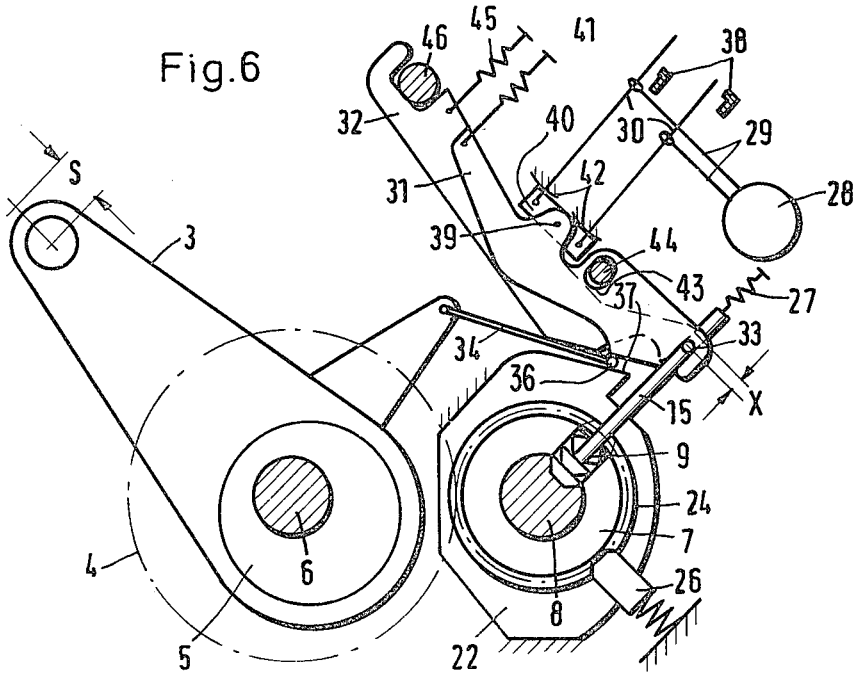

At the end of one rotation of the drive shaft 8 by 360° the control is in the position shown in FIG. 6, in which position the wedge 9 already has been uncoupled again by the switching rod 15 under the effect of the tension spring 27. Simultaneously the roller 36 on the pulse member 34 has been pushed under the control lever 31 by the lever 35, the latter being secured on the connecting rod 3, so that also the control lever 31 is again in its starting position.

Figure 7:
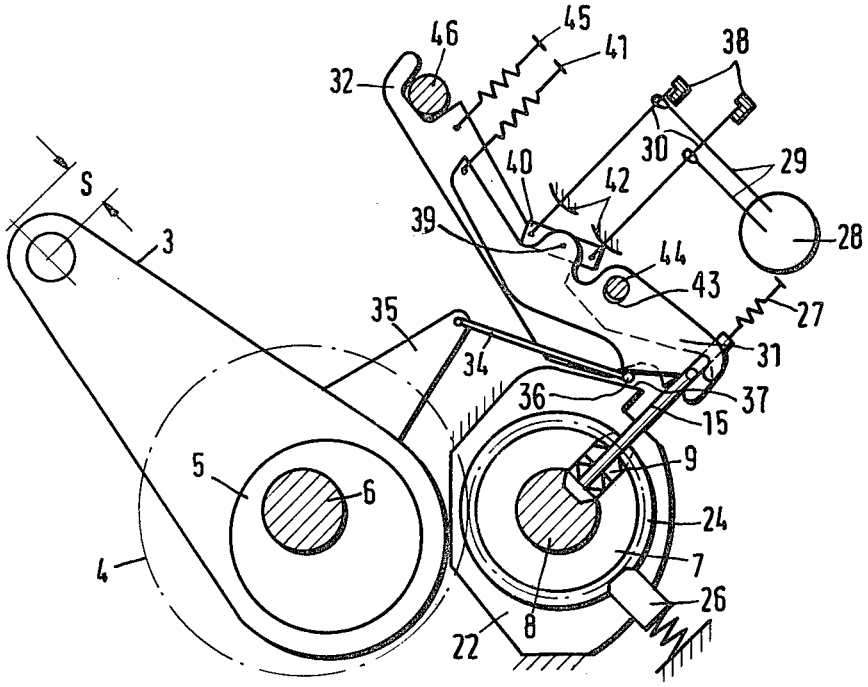

With the control position shown in FIG. 7, the sensing needles 29 have found a hole in the card so that the pressure needles 30 are pressed or driven out. While the control end of the control lever 31 is blocked in its starting position by the pulse member 34, the control lever 32 with its control end is able to make the coupling path x and to connect the wedge 9. In so doing the control lever 32 is drawn by its tension spring 45 against a stop or abutment 46.

Figure 8:
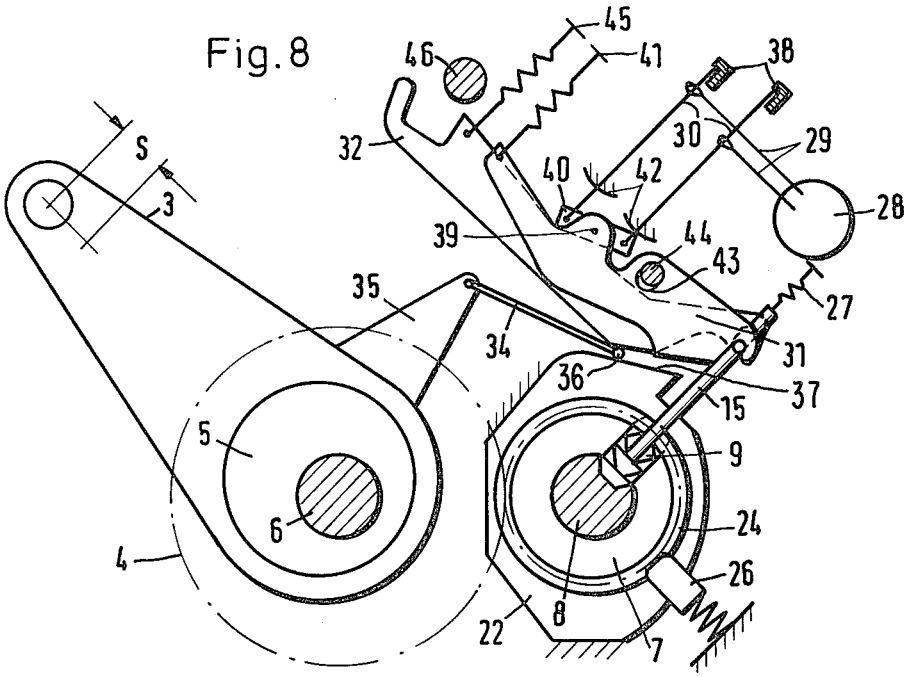

The control position at the end of the shaft movement from the bottom shed to the upper shed is shown in FIG. 8. The wedge 9 is uncoupled from the drive shaft 8 because the tension spring 45 has pivoted the control lever 32 around its pivot axle 39 and the pulse member 34 has blocked the control lever 32, so that the tension spring 27 was able to pull the switching member 15 back into its starting position. As soon as the pressure guides 38 are lifted off from the pressing needles 30, all the parts of the control again move into the starting position shown in FIG. 5 before the coupling-in of the wedge 9.

As one example only, the drive device for both pressure rails 38 and the moveable control axle 44 is seen in FIG. 10, which may be a separate cam disc 49 which is driven by the weaving machine, from which the back and forth movements for the pressure rails 38 and the moveably control axle 44 can be taken off.

In FIG. 9 there is shown a preferred embodiment without the guide ring 22 and the ring 24. With this embodiment the uncoupled wedge 9 engages or catches in a recess 47 of a resiliently mounted pawl, latch or detent 48. Otherwise, the functions or performances of the drive and the control have remained unchanged.

All the new features mentioned in the descriptions and shown in the drawings are essential to the invention, including insofar as they have not been explicitly claimed in the claims.

We claim:

1. In a control for a wedge coupling in a dobby mechanism with a reduction gearing between a drive shaft and an eccentric device for the dobby movement, a coupling place, and a spring-tensioned switching member, controlled according to a pattern, for the movement of the wedge, the improvement comprising two spring-tensioned control levers for the upper and lower shed movement, said control levers operatively engage the switching member, needle means for controlling said control levers, control axle means for being synchronously movable with the dobby mechanism, one of said control levers additionally cooperates with said control axle means, a pulse means is synchronously controlled by the eccentric device, said pulse means for blocking a control end of a not to be moved of said control levers in a starting position thereof.

2. The control according to claim 1, further comprising a balance lever is operatively connected between said needle means and said control levers, said needle means includes two pressing needles, said balance lever cooperates with said two pressing needles.

3. The control according to claim 1, wherein said one control lever is formed with an oblong hole disposed on said control axle means.

4. The control according to claim 1, wherein said eccentric device includes a connecting rod operatively connected to said pulse means.

5. The control according to claim 1, wherein the control ends of said control levers operatively engage the switching member.

6. The control according to claim 3, further comprising a pin means on said switching member for the operative engagement, respectively, of said control levers, a movable pivot axle of the balance lever, said one control lever cooperates with said pivot axle of the balance lever, the length ratios on said one control lever between the pivot axle of the balance lever, said control axls means and said pin means on said switching member are dimensioned such that with a stroke of said pivot axle of the balance lever and of said control axle means no wedge coupling impulse occurs on said pin means of said switching member.

7. The control according to claim 6, wherein said pivot axle is pivotally connected to both of said control levers and arranged on said balance lever such that each of said levers has two arms, spring tension means for biasing said control levers, respectively, fixed abutment means for operatively being engaged by said balance lever and the other of said control levers, respectively.

8. The control according to claim 7, wherein said abutment means have an abutment face facing a side of said balance lever and a side of said other control lever, respectively, which sides are remote from the coupling place, means for biasing said switching member in a general direction toward said abutment means for uncoupling of the wedge from connection between the drive shaft and the reduction gearing, said control ends of said control levers constitute one arm of each of said two arms of said control levers, respectively, and operatively engage said pin means for moving said pin means with a wedge coupling impulse in a direction against the biasing of said means for biasing said switching member, said spring tension means for operatively biasing said other of said two arms of said control levers in a general direction toward said abutment means, one of said abutment means is positioned in a path of movement of said other arm of said other control lever.

9. The control according to claim 8, wherein said needle means is for controlling said control levers via said balance lever in dependency on said pattern, said two pressing needles are connected to respective of said two arms of said balance lever.

10. The control according to claim 9, further comprising a stationary cam, said pulse means includes a roller engaging said stationary cam at different positions depending on the position of the eccentric device and in said different positions, respectively, blockingly engaging another side of said not to be moved control levers, respectively, which another side faces the coupling place.

* * * * *